United States Patent [19]

Bellanger

[11] Patent Number: 4,836,900

[45] Date of Patent: Jun. 6, 1989

[54] PROCESS FOR THE DECONTAMINATION OF THE SURFACE OF A METAL PORT CONTAMINATED BY TRITIUM AND APPARATUS USABLE FOR THIS PROCESS

[75] Inventor: Gilbert Bellanger, Selongey, France

[73] Assignee: Commissariat a l'Energie Atomique, Paris, France

[21] Appl. No.: 141,407

[22] Filed: Jan. 4, 1988

[30] Foreign Application Priority Data

Jan. 5, 1987 [FR] France ..... 8700017

[51] Int. Cl.[4] ..... C25F 1/00

[52] U.S. Cl. ..... 204/140

[58] Field of Search ..... 204/140, 141.5, 145 R

[56] References Cited

U.S. PATENT DOCUMENTS 3,515,655 6/1970 Raviv et al. ..... 204/141.5
3,957,597 5/1976 Maroni ..... 204/60

FOREIGN PATENT DOCUMENTS 0144036 6/1985 European Pat. Off. .
1192522 5/1965 Fed. Rep. of Germany .
1481593 5/1967 France .
2533356 3/1984 France .
2561672 9/1985 France .

*Primary Examiner*—T. M. Tufariello
*Attorney, Agent, or Firm*—Michael N. Meller

[57] ABSTRACT

The invention relates to a process for decontaminating the surface of a metal part contaminated by tritium and an apparatus usable for performing this process.

In order to carry out said decontamination, the part (9) to be decontaminated is connected to the negative pole of a direct current generator, at least one portion of the surface of said part is contacted with a mixture incorporating water and an electrolyte, e.g. an aqueous solution of soda or sulphuric acid, or water and solid electrolyte (3), an electric current is passed between part (9) and anode (1) connected to the positive pole of the electric current generator (5) by applying to part (9) a current density of 10 to 50 $mA.cm^{-2}$ for the cathodic hydrogen charging of part (9) and the replacement by hydrogen of the tritium absorbed on the surface of said part.

13 Claims, 2 Drawing Sheets

Figure 1:
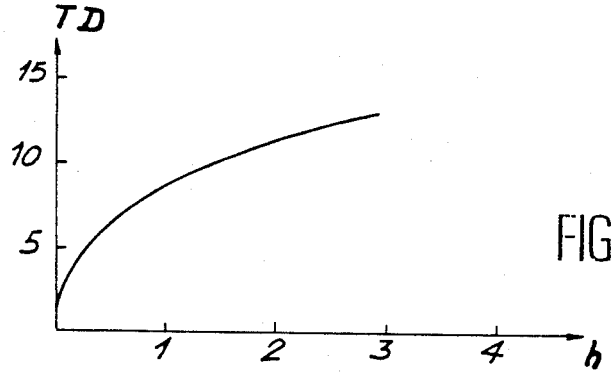

PROCESS FOR THE DECONTAMINATION OF THE SURFACE OF A METAL PORT CONTAMINATED BY TRITIUM AND APPARATUS USABLE FOR THIS PROCESS

The present invention relates to a process for the decontamination of the surface of metal parts contaminated with tritium. It more specifically relates to an electrolytic decontamination process making it possible to eliminate the tritium present on the surface of a metal part without modifying the profile of the surface of said part, so as to optionally permit the reuse thereof.

This process more particularly applies to small metal parts with a complex geometry, to parts having a large surface area but a simple geometry, as well as to parts having relatively inaccessible areas, such as those with a contorted geometry.

Among the presently known processes for decontaminating parts contaminated with radioactive materials it is possible to use electrolytic processes, like those described in French Pat. Nos. 2 490 685 and 2 533 356 and U.S. Pat. No. 3 515 655.

In these patents, which use electrolytic processes for decontaminating metal parts, a demineralization of the surface of the parts is obtained, which makes it possible to extract the radio-active particles present on said surface. These operations suffer from the disadvantage of being destructive and of modifying the surface profile of the parts, which can consequently not be directly reused after treatment. Moreover, the processes described in these patents do not relate to the decontamination of parts contaminated by tritium.

The present invention specifically relates to a process for the decontamination of the surface of metal parts contaminated by tritium making it possible to obviate the disadvantages of the processes described hereinbefore. The process according to the invention for decontaminating the surface of a metal part contaminated by tritium comprises the following stages:

(1) connecting the part to be decontaminated to the negative pole of a direct current generator, (2) contacting at least one portion of the surface of the part to be decontaminated with a mixture incorporating water and an electrolyte able to release hydrogen by electrolysis, and (3) passing an electric current between the part to be decontaminated and an anode connected to the positive pole of the electric current generator and in contact with the mixture incorporating water and an electrolyte, by applying to the part to be decontaminated a current density of 10 to 50 mA/cm$^2$ and preferably 10 to 25 mA/cm$^2$ in order to cathodically charge with hydrogen the surface of the part to be decontaminated and thus replace by the hydrogen the tritium adsorbed on the surface of the part to be decontaminated.

The process according to the invention uses low current densities, which make it possible to effect a cathodic hydrogen charging of the surface of the part. Thus, through the choice of current densities of 10 to 50 and preferably 10 to 25 mA/cm$^2$, the hydrogen can be adsorbed on the surface of the part, whereas in the prior art processes, such as that of U.S. Pat. No. 3,515,655, higher current densities are used and there is a significant evolution of hydrogen, which assists decohesion of the metal. This leads to the growth of cavities and cracks and consequently surface particles are torn away and the treated part undergoes demetallization.

Thus, at current densities of 10 to 25 mA/cm$^2$, the hydrogen formed by electrolysis is largely adsorbed on the surface of the cathode. At current densities of 25 to 50 mA/cm$^2$, there is simultaneously an adsorption of the hydrogen on the cathode and an evolution of gaseous hydrogen, whilst at current densities above 50 mA/cm$^2$, there is only an evolution of gaseous hydrogen.

Thus, in the case of the process of U.S. Pat. No. 3,515,655, there is no cathodic hydrogen charging, but solely a gaseous hydrogen evolution, which leads to the tearing away of the metal particles and the radioactive particles deposited on the surface to be decontaminated. Moreover, it is not a question of tritium and, with radioactive particles other than tritium, there would be no decontamination at current densities below 50 mA/cm$^2$ and there would only be a hydrogen charging of the part.

In the invention, the hydrogen is released in the same way as in the prior art processes by the following reaction: $2H_2O+2e \rightarrow 2H+2OH$, but the released hydrogen quantity is lower and it then reacts with the tritium adsorbed on the surface of the part in accordance with two mechanisms, which are illustrated by the following reactions:

(a) adsorption of hydrogen and insertion of tritium into deeper layers of the part:

$$H+MTads+M \rightarrow MH\ ads+MTins$$

in which M represents the metal or metals constituting the part, ads means adsorbed and ins means inserted and (b) transfer of tritium into the water-electrolyte mixture:

$$H+MTads \rightarrow MHads+T$$

in which M and ads have the meanings given hereinbefore.

These reaction mechanisms are governed by different parameters, such as electrochemical parameters, e.g. the current density, cathodic overvoltage and the nature of the electrolyte, the temperature and the electrolysis time.

Thus, when the cathodic overvoltage is at a correct value hydrogen adsorption is assisted and the energy variation between H-M and T-M leads to the insertion of tritium into the part and the transfer of tritium into the water.

At the end of the operation, a part is obtained, whose surface is charged with hydrogen, a water-electrolyte mixture containing part of the tritium present on the surface of the part and tritium inserted into the deeper layers of the part.

The replacement of the tritium adsorbed on the surface of the part by hydrogen makes it possible to form a hydrogen barrier, which blocks the back diffusion of tritium inserted into the part. Therefore this process is of great interest, because the surface layers of the part are not damaged and the part can be recycled after treatment.

Generally the mixture incorporating water and an electrolyte is constituted by an aqueous solution of an electrolyte chosen in such a way that the aqueous solution can release hydrogen by electrolysis. For example, this electrolyte can be sulphuric acid or an alkali metal hydroxide such as soda. Preference is given to the use of soda, because it delays the evolution of hydrogen. In the case of sulphuric acid, there is an etching of the metal as from 50 $mA/cm^2$ and the etching speed, i.e. the corrosion, increases as from said value with the current density.

Preferably, the electrolyte concentration of the solution is low, in order to avoid corrosion of the part to be treated. It is therefore conventional practice to use aqueous solutions containing 0.1 to 1 $mole.l^{-1}$ of sulphuric acid or alkali metal hydroxide, such as NaOH.

However, it is also possible to use more concentrated solutions, but this is not really of interest, because the effluents obtained are much more difficult to treat.

According to a first embodiment of the process according to the invention, which is particularly appropriate for the treatment of small parts, then part to be decontaminated is immersed in water or an aqueous solution, preferably constituted by an aqueous electrolyte solution, such as those described hereinbefore. In this case, the anode can be also immersed in water or the aqueous solution. However, it is more advantageous to use as the anode the vessel containing the water or a clear solution. This vessel can e.g. be made from graphite impregnated with polytetrafluoroethylene wax, which is resistant to chemical etching and has no porosity as compared with pure graphite. As a result the water or aqueous solution cannot pass through the vessel by capillarity.

In this embodiment of the inventive process, it is possible to simultaneously treat several parts by placing them in an electricity conducting basket connected to the negative pole of a direct current generator.

According to a second embodiment of the process, more particularly suitable for the treatment of large parts, electrolysis is effected by using the so-called buffer electrolysis method. In this case an assembly comprising the anode and a solid electrolyte is passed over the surface of the part and water is circulated between the solid electrolyte, the anode and the surface of the part to be decontaminated.

The solid electrolyte can be constituted by an ionic conductive polymer, which is ionizable by water or an aqueous solution. It is e.g. possible to use perfluorosulphonic acid of formula:

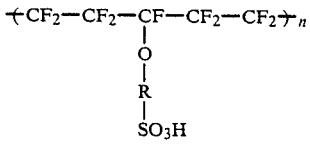

in which R represents an organic radical and n is a polymerization number, which is ionizable by pure water.

This embodiment of the process is advantageous because it makes it possible to eliminate the use of chemical agents in solution, which are responsible for corrosion, as well as the problems of the reprocessing of effluents. Moreover, it makes it possible to decontaminate more highly tritiated zones and to reach zones which are not very accessible by other treatments. Finally, it is adapted to the realisation of an in situ decontamination and also leads to little tritiated waste.

In this second embodiment of the process, the anode can be made from graphite impregnated or not with polytetrafluoroethylene wax.

In general, for carrying out the decontamination according to this second embodiment, use is made of an assembly having an anode and a solid electrolyte and which is provided with means for bringing about circulation of the water or aqueous solution between the anode, the solid electrolyte and the part to be decontaminated.

The present invention also relates to an apparatus for the electrolytic treatment of the surface of a metal part, characterized in that it comprises a hollow electricity conducting material body connected to one of the poles of an electric current generator, the hollow body being provided with at least one liquid outlet port to which is applied a porous, permeable element made from electricity conducting material, a solid electrolyte applied to the outer surface of the porous, permeable element and means for displacing the hollow body on the surface of the part to be treated, so that the solid electrolyte as in contact with the part and means for introducing a liquid into the hollow body and for circulating it through the outlet port between the porous, permeable electricity conducting material element and the surface of the part to be treated.

The hollow body, which in the inventive process constitutes the anode of the apparatus, can be made from polytetrafluoroethylene wax-impregnated graphite and the porous, permeable element can be constituted by a graphite felt. The solid electrolyte applied to the outer surface of the porous element can be made from an ionic conductive polymer, ionizable by water or an aqueous solution, e.g. of perfluoro carboxylic sulphonic acid.

According to a variant of these embodiments, more particularly suitable for the treatment of small parts with a contorted geometry, it is possible to move an assembly comprising the anode and the solid electrolyte over the surface of the parts to be decontaminated and which are immersed in water. In this case, the solid electrolyte-anode assembly can be constituted by a graphite part having on one of its faces a graphite felt externally coated with the solid electrolyte, e.g. an ionic conductive solid polymer.

According to a variant of the second embodiment, it is also possible to use an anode-solid electrolyte-cathode sandwich. In this case, the apparatus also comprises a cathodic element of palladium black and/or nickel into which the hydrogen can diffuse, said element being applied to the solid electrolyte, in such a way that when the hydrogen has diffused into said element, it is directly implanted in the part to be decontaminated. In this variant, the cathodic face of the solid electrolyte can be successively coated with palladium black by impregnation and nickel over a thickness of 250 microns. The palladium black can be deposited from palladium salts in aqueous solution and then the nickel can be deposited by metallization by the chemical route or cathodic sputtering, followed by the electrolysis of a nickel salt.

In this variant, the hydrogen diffuses into the nickel cathode. The atomic hydrogen is recovered on the opposite face and is directly implanted on the part to be decontaminated, which is attached to said assembly.

In this variant, it is also possible to use an anode-solid electrolyte-cathode sandwich, in which the Pd and/or Ni black forming the cathodic adsorption element are fitted into the underlying layers of the solid electrolyte. This has the advantage of increasing the adsorption surface of the cathodic hydrogen on the part to be decontaminated.

For example, it is possible to obtain this sandwich structure by impregnating the conductive polymer with an ionic compound of Ni or palladium, which is not an anionic complex, e.g. $NiCl_2$ or $Pd(No_3)_2$ and by soaking the polymer in a 25% dimethyl aminoborane solution at 85° C. Under these conditions, this organic compound decomposes and gives rise to atomic hydrogen within the polymer and said hydrogen chemically reduces the $Pd^{2+}$ or $Ni^{2+}$ cations to the finely divided metal state in the first underlying layers of the polymer.

The parts which can be decontaminated by the inventive process can be made from different metals and alloys, provided that the electrolyte and the electrolysis conditions are chosen in such a way as to prevent corrosion of the material. For example, the process can apply to the treatment of stainless steel parts or parts made from copper alloys, e.g. of brass.

The process according to the invention can be performed at ambient temperature, but it is also possible to operate at higher temperatures, but because the temperature plays a significant part with respect to the insertion of the tritium into the deep layers of the part. Thus, the quantity of adsorbed H or T decreases with the temperature during electrolysis. In the same way, the diffusion of H or T into the cathode increases with the temperature. There is a slight back diffusion, but most of the H or T remains blocked in the metal and blocking becomes even greater on return to ambient temperature.

It is also preferable to operate at temperatures above the ambient temperature, whilst avoiding corrosion risks, e.g. at temperatures of 25° to 100° C. and especially 80° C.

In the process according to the invention, the electrolysis duration also constitutes an important parameter, because it acts on the eliminated tritium quantity. However, in the first embodiment of the process, where the parts are immersed in water or an aqueous solution, at the end of a certain time a balance is obtained between the tritium concentration in the water or aqueous solution and the tritium concentration in the part to be treated. Thus, this corresponds to the following reaction:

$$T+H_2O \rightleftharpoons HTO+H$$

Furthermore, if in the first embodiment of the process it is wished to obtain a higher decontamination ratio, it is necessary to carry out successively several decontamination cycles on the same part using for each cycle a new aqueous solution or a new water charge.

Other features and advantages of the invention can be gathered from the following description relative to an embodiments and the attached drawings, wherein show:

FIG. 1 a graph showing the evolution of the decontamination ratio as a function of the treatment time.

Figure 2:
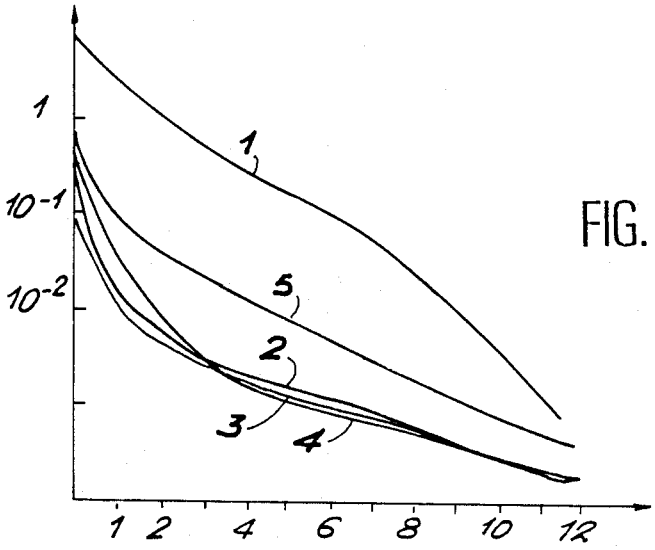

FIG. 2 a graph showing the evolution of the tritium surface activity of a part as a function of the number of decontamination cycles.

Figure 3:
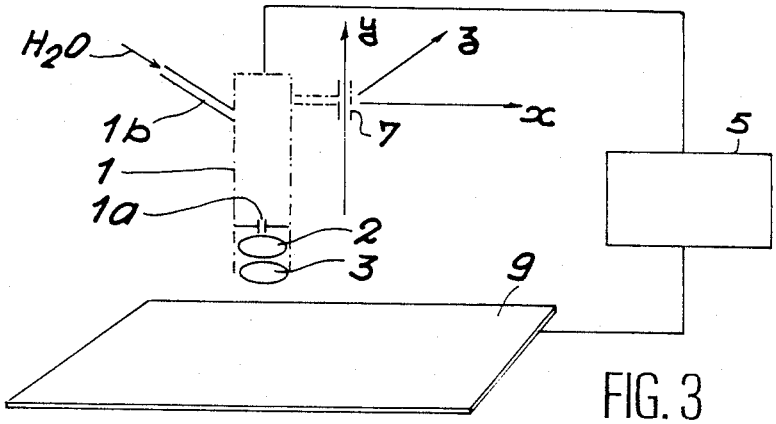

FIG. 3 diagrammatically an anode-mobile electrolyte assembly usable in the second embodiment of the invention process.

Figure 4:
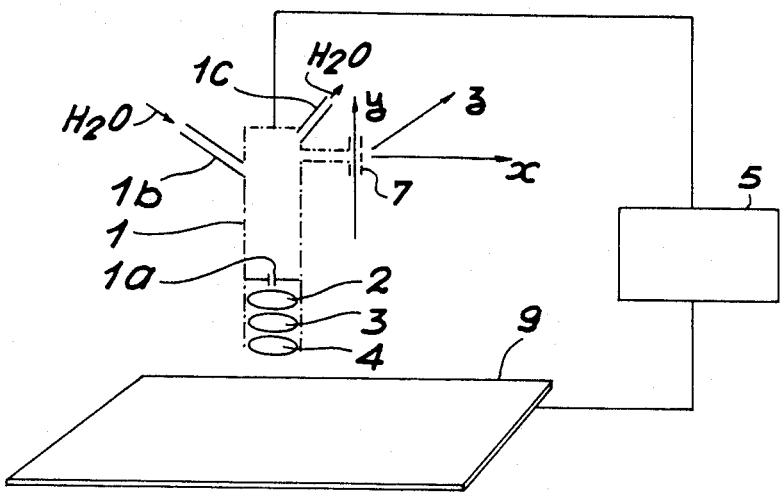

FIG. 4 diagrammatically the anode-solid electrolyte polymer-mobile nickel and palladium black cathode assembly usable in the case of the implantation of atomic diffusion hydrogen.

The following examples relate to the decontamination of parts made from stainless steel or brass contaminated by tritium.

EXAMPLE 1

This example involves the surface decontamination of stainless steel parts using the first embodiment of the process, i.e. immersion of the parts in an aqueous solution containing 1 mole.$L^{-1}$ of NaOH, placed in a heated polytetrafluoroethylene wax-impregnated graphite vessel, which constitutes the anode of the apparatus. Working takes place with a current density applied to the surface of the parts of 10 mA.$cm^{-2}$, at a temperature of 80° C. and electrolysis is performed for two hours.

At the end of this treatment, the tritium decontamination ratio (DR) is determined and this corresponds to the tritium surface activity ratio of the part before treatment of the surface activity of the part after treatment. The thickness loss of the part is also determined.

This is followed by 12 identical treatment cycles using for each cycle a new aqueous NaOH solution and the tritium decontamination ratio is determined after these 12 cycles. The results obtained are given in Table 1, where the electrolytic treatment conditions are also indicated.

EXAMPLE 2

In this example brass parts are treated in the same way as in example 1, but using an aqueous solution containing 1 mole.$L^{-1}$ of sulphuric acid in place of the aqueous NaOH solution. As hereinbefore, the decontamination ratio and the thickness loss of the part are determined after a treatment cycle. The results obtained are also given in Table 1.

EXAMPLE 3

This example studies the influence of the electrolysis time on the decontamination ratio obtained. Electrolysis is performed under the conditions of example 1 on stainless steel parts and the surface activity of the part is measured as a function of the duration of electrolysis performed in the same solution.

The results obtained are given in FIG. 1, which represents the increase in the surface decontamination ratio (DR) as a function of the electrolysis time in hours. It can be seen that the decontamination ratio virtually no longer increases after two hours, due to the equilibrium established between the tritium concentration of the solution and the tritium concentration of the part, as has been shown hereinbefore.

EXAMPLE 4

In this example different stainless steel parts are decontaminated by using the electrolysis conditions of example 1 and trreatment cycles lasting two hours.

Several treatment cycles are successively performed on five parts constituted by a ball (part 1), a flask (part 2), a collar (part 3), a rod (part 4) and another flask (part 5) and after each cycle the tritium surface activity of the parts is determined (in micro Ci.$cm^{-2}$).

The results obtained are given in FIG. 2, which represents the evolution of the surface activity of the parts as a function of the number of treatment cycles. Curves 1, 2, 3, 4 and 5 respectively relate to parts 1, 2, 3, 4 and 5. It can be seen that in all cases the surface activity of the part decreases with the number of treatment cycles.

EXAMPLE 5

This example illustrates the use of the so-called buffer process for decontaminating stainless steel parts. This example uses the apparatus diagrammatically shown in FIG. 3, which comprises an anode constituted by a hollow polytetrafluoroethylene wax-impregnated graphite cylinder 1, which is provided at its base with an outlet port 1*a*, to which is applied a porous, permeable graphite felt element 2 and a solid ionic conductive polymer film 3, constituted by perfluoro sulphonic acid, the felt and the film 3 being fixed to cylinder 1 by appropriate means not shown in the drawing.

The hollow graphite cylinder 1 is also provided with a liquid introduction orifice 1*b* by which water can be circulated in the hollow anodic cylinder, the water then flowing through orifice 1*a* through the graphite felt 2 and the ionic conductive polymer film 3. The hollow graphite cylinder can be connected to the positive pole of the electric current generator 5 and it can be displaced in the three directions in space by any appropriate means, e.g. by an automatic laboratory device 7.

This device can be used for decontaminating the flat part 9, which is connected to the negative pole of generator 5. Under these conditions, the hollow graphite cylinder 1 is moved to bring it into contact with the part, so as to circulate water in the graphite cylinder 1 through the graphite felt 2 and the ionic conductive polymer film 3 on the surface of the part.

The assembly is moved on part 9 and the speed and displacement mode is regulated so as to obtain a satisfactory decontamination.

For example, a device of this type was used for decontaminating a stainless steel plate using a current density on the plate of 10 to 50 $mA.cm^{-2}$ and a hollow cylinder displacement speed of 40 $cm.min^{-1}$. The total time for carrying out the decontamination of a 10 $cm^2$ plate with a length of 10 cm is one hour.

The tritium decontamination ratio of the surface of the part and the thickness loss are then determined as hereinbefore. The results obtained and treatment conditions are given in Table 2.

Thus, a good decontamination ratio can be obtained with a negligible thickness loss.

In this type of device the operating temperature is above ambient temperature, due to the Joule effect obtained by electrolysis.

EXAMPLE 6

This is a variant of example 5, where use is made of the property of the diffusability of atomic hydrogen into a nickel cathode. Use is made of the apparatus diagrammatically shown in FIG. 4, which is identical to that of FIG. 3, but to which has been added a 250 μm palladium black and nickel cathode 4 between the ionic conductive polymer film and the plate to be decontaminated. This apparatus has orifice 1*c* for the discharge of the water contained in the hollow cylinder 1.

For example, use was made of an apparatus of this type for decontaminating a stainless steel plate by using a current density on the plate of 20 $mA.cm^{-2}$, an electrolyte temperature between 60° and 80° C. and a hollow cylinder displacement speed of 40 to 200 $cm.min^{-1}$. The total number of cycles for performing the decontamination of a 10 $cm^2$ plate with a length of 10 cm is 700.

The tritium decontamination ratio of the surface of the part is determined in the same way. In this case, it undergoes no thickness loss and it is possible to use materials which are degraded by cathodic polarization and electrolytes, such as alloys of aluminum and copper. The results obtained and the processing conditions are given in the following Table 3.

EXAMPLE 7

In this example, use is made of the first embodiment of the inventive process for treating a stainless steel part with average dimensions and a complicated geometry constituted by a valve, whose orifice is highly contaminated by tritium. The part is placed in a tank containing water and into the orifice to be decontaminated is introduced an anode-solid electrolyte assembly constituted by a graphite rod covered with graphite felt and an ionic conductive solid polymer film.

Electrolysis is performed with a current density of 10 $mA.cm^{-2}$ for two hours at the temperature obtained by the Joule effect due to electrolysis. At the end of the operation, the tritium decontamination ratio of the surface of the part and its thickness loss in micrometers are determined. The results obtained and the treatment conditions are given in Table 4.

The invention is not limited to the embodiments envisaged or described hereinbefore. In particular, for the so-called buffer electrolysis process, it is possible to use conventional equipment, like those described in French Pat. Nos. 2 490 685 and 2 533 356. It is also possible to use other materials for producing the anodes used in the inventive process, as well as other materials as solid electrolytes, which can be associated with water or appropriate aqueous solutions. Moreover, when using the buffer electrolysis process, it is possible to employ electrolytes in aqueous solution, e.g. a soda solution or a sulphuric acid solution.

TABLE 1

| Example (treated material) | Electrolyte | Temperature (°C.) | Cycle time (hours) | Current density ($mA \cdot cm^{-2}$) | Thickness loss (μm) after one cycle | DR after one cycle | DR after 12 cycles |
|---|---|---|---|---|---|---|---|
| 1 (stainless steel) | NaOH 1 $mol \cdot l^{-1}$ | 80° C. | 2 | 10 | $10^{-2}$ | 10 | $10^4$ |
| 2 (brass) | $H_2SO_4$ 1 $mol \cdot l^{-1}$ | 80° C. | 2 | 10 | $10^{-1}$ | 10 | / |

TABLE 2

| Example 5 (treated material) | Electrolyte | Sweep speed | Treated part length | Time (hours) | Current density ($mA \cdot cm^{-2}$) | Thickness loss (μm) | DR |
|---|---|---|---|---|---|---|---|
| stainless steel | $H_2O$ + perfluoro | 40 $cm \cdot min^{-1}$ | 10 cm | 1 | 10 to 50 | negligible | 10 |

TABLE 2-continued

| Example 5 (treated material) | Electrolyte | Sweep speed | Treated part length | Time (hours) | Current density ($mA \cdot cm^{-2}$) | Thickness loss ($\mu m$) | DR |
|---|---|---|---|---|---|---|---|
| | sulphonic acid. | | | | | | |

TABLE 3

| Example 6 (treated material) | Electrolyte | Cathode | Sweep speed | Treated part length | Cycle no. | Electrolyte temperature | Current density | Thickness loss | DR |
|---|---|---|---|---|---|---|---|---|---|
| Stainless steel | $H_2O$ + perfluoro sulphonic acid | palladium dium nickel 250 $\mu m$ | 40 to 200 $cm \cdot mn^{-1}$ | 10 cm | 700 | 60 to 80° C. | 20 $mA \cdot cm^{-2}$ | 0 | 5 |

TABLE 4

| Example 7 (treated material) | Electrolyte | Time (hours) | Current density ($mA \cdot cm^2$) | Thickness loss ($\mu m$) | DR |
|---|---|---|---|---|---|
| Stainless steel | $H_2O$ + perfluoro sulphonic acid | 2 | 10 | $10^{-2}$ | 10 |

I claim:

1. Process for the decontamination of the surface of a metal part contaminated by tritium, characterized in that it comprises the following stages:

(1) connecting the part to be decontaminated to the negative pole of a direct current generator, (2) contacting at least one portion of the surface of the part to be decontaminated with a mixture incorporating water and an electrolyte able to release hydrogen by electrolysis, and (3) passing an electric current between the part to be decontaminated and an anode connected to the positive pole of the electric current generator and in contact with the mixture incorporating water and an electrolyte, by applying to the part to be decontaminated a current density of 10 to 50 $mA/cm^2$ in order to cathodically charge with hydrogen the surface of the part to be decontaminated and thus replace by the hydrogen the tritium adsorbed on the surface of the part to be decontaminated.

2. Process according to claim 1, characterized in that the mixture incorporating water and electrolyte is constituted by an aqueous solution wherein the electrolyte is selected from the group consisting of alkali metal hydroxide and sulphuric acid.

3. Process according to claim 2, characterized in that the mixture incorporating water and electrolyte is constituted by an aqueous soda solution.

4. Process according to claim 1, characterized in that the anode is made from polytetrafluoroethylene wax-impregnated graphite.

5. Process according to claim 1, characterized in that the part to be decontaminated is immersed in a solvent selected from the group consisting of water and an aqueous solution.

6. Process according to claim 5, characterized in that the anode is constituted by a vessel containing the water-electrolyte mixture.

7. Process according to claim 1, characterized in that the electrolyte is a solid electrolyte.

8. Process according to claim 7, characterized in that the solid electrolyte is an ionic conductive polymer.

9. Process according to claim 8, characterized in that the solid electrolyte is perfluoro sulphonic acid of formula:

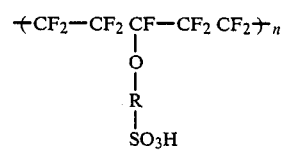

in which R represents an organic radical and n is a polymerization number.

10. Process according to claim 7, characterized in that an assembly incorporating the anode and the solid electrolyte is moved over the surface of the part and in that water is circulated between the anode, the solid electrolyte and the surface of the part to be decontaminated.

11. Process according to claim 1, characterized in that the part to be decontaminated is selected from the group consisting of stainless steel and a copper alloy.

12. A process according to claim 1 wherein the current density is from 10 to 25 $mA/cm^2$.

13. A process according to claim 7, characterized in that an assembly incorporating the anode and the solid electrolyte is moved over the surface of the part and in that an aqueous solution is circulated between the anode, the solid electrolyte and the surface of the part to be decontaminated.

* * * * *